US011846063B2

(12) United States Patent
Chirumbolo

(10) Patent No.: US 11,846,063 B2
(45) Date of Patent: Dec. 19, 2023

(54) MOTORIZED LOCK SWITCH MODULE FOR A DOOR-LOCK FOR APPLIANCES

(71) Applicant: Illinois Tool Works Inc., Glenview, IL (US)

(72) Inventor: Dino Chirumbolo, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 853 days.

(21) Appl. No.: 16/956,061

(22) PCT Filed: Jan. 24, 2019

(86) PCT No.: PCT/US2019/014966
§ 371 (c)(1),
(2) Date: Jun. 19, 2020

(87) PCT Pub. No.: WO2019/147821
PCT Pub. Date: Aug. 1, 2019

(65) Prior Publication Data

US 2020/0347641 A1 Nov. 5, 2020

(30) Foreign Application Priority Data

Jan. 29, 2018 (IT) ..... 102018000002107

(51) Int. Cl.
*D06F 39/14* (2006.01)
*H01H 9/28* (2006.01)
(Continued)

(52) U.S. Cl.
CPC ..... *D06F 39/14* (2013.01); *E05B 47/0001* (2013.01); *H01H 9/286* (2013.01);
(Continued)

(58) Field of Classification Search
CPC ..... D06F 39/14; D06F 37/28; D06F 37/10; D06F 58/20; E05B 2047/0067;
(Continued)

(56) References Cited

U.S. PATENT DOCUMENTS

2008/0106105 A1* 5/2008 Spiessl ..... D06F 39/14 292/210
2015/0048627 A1* 2/2015 Becchio ..... A47L 15/4259 292/144
(Continued)

FOREIGN PATENT DOCUMENTS

EP 2537974 A1 12/2012
WO 2012042554 A1 4/2012
(Continued)

OTHER PUBLICATIONS

International Search Report for PCT/US2019/014966, dated Mar. 4, 2019.
(Continued)

*Primary Examiner* — Ahmed M Saeed
(74) *Attorney, Agent, or Firm* — Boyle Fredrickson, S.C.

(57) ABSTRACT

A lock switch module for an appliance door-lock is provided. The lock switch module may include a PCB (printed circuit board) with an insulating support, multiple conductive tracks applied to the insulating support, an electrical connector, multiple terminals connected to respective conductive tracks, and a door-lock switch that is electrically connected between two of the conductive tracks. A locking pin can move between retracted and extracted positions and cooperate with the door-lock switch to correspondingly change the door-lock switch's state. A low voltage electric motor has a rotating output shaft and is connected electrically to at least two conductive tracks of the PCB. A transmission mechanism is operatively positioned between the output shaft of the electric motor and the locking pin to
(Continued)

drive, following the actuation of the electric motor, the movement of the locking pin between the retracted and extracted positions.

10 Claims, 10 Drawing Sheets

(51) Int. Cl.
*E05B 47/00* (2006.01)
*D06F 34/10* (2020.01)
*D06F 34/20* (2020.01)

(52) U.S. Cl.
CPC ..... *D06F 34/10* (2020.02); *D06F 34/20* (2020.02); *E05B 2047/0054* (2013.01); *E05B 2047/0067* (2013.01); *E05Y 2900/312* (2013.01)

(58) Field of Classification Search
CPC ..... E05B 47/0001; E05B 47/0012; E05B 2047/002; E05B 47/026; E05B 2047/0058; E05B 47/00; E05B 2047/0094; E05B 2047/0095; H01H 9/286
See application file for complete search history.

(56) References Cited

U.S. PATENT DOCUMENTS

2021/0115702 A1* 4/2021 Promutico ..... E05B 9/02
2021/0222459 A1* 7/2021 Promutico ..... D06F 58/20

FOREIGN PATENT DOCUMENTS

WO 2016089806 A2 6/2016
WO 2016199056 A1 12/2016

OTHER PUBLICATIONS

Italian Search Report for IT 10 2018/000002107, dated Oct. 2, 2018.
International Preliminary Report On Patentability for PCT/US2019/014966, dated Aug. 4, 2020.
Written Opinion of the International Searching Authority for PCT/US2019/014966, dated Aug. 4, 2020.

* cited by examiner

MOTORIZED LOCK SWITCH MODULE FOR A DOOR-LOCK FOR APPLIANCES

FIELD OF THE INVENTION

The present invention refers to door-lock devices for appliances such as washers, washer-dryers, and it relates to a block switch module for a door-lock.

BACK GROUND OF THE INVENTION

A door-lock has the purpose of ensuring that the door of an appliance is locked in the closed position and can be opened only after the end of an operating cycle.

A door-lock usually comprises a rotating cam adapted to engage a hook borne by the door of an appliance and a lock cursor able to lock the rotating cam in a position of engagement of the hook.

The door-lock is normally associated with a lock switch module including a locking pin able to lock the block cursor in the locked door position. The lock switch module usually comprises a solenoid electromagnetic actuator that commands the movement of the locking pin between a disengaged position and a locked position, and vice versa. The electromagnetic actuator is connected to conductors formed by strips of cut and bent sheet metal, whose ends form terminals intended to be connected to a control unit of the appliance. The lock switch module normally comprises a lock switch cooperating with the locking pin and able to signal to the control unit of the appliance that the locking pin is in a locked position. In certain cases, the lock switch module also comprises a door sensing pin that prevents the lock switch from closing if the door of the appliance is not closed.

WO2013181289 describes an example of a door-lock for appliances provided with a lock switch module including a door sensing pin that cooperates with a bistable switch electrically connected between two fixed electric contacts. The bistable switch is controlled by the door sensing pin and it snaps from an open position to a closed position when the door sensing pin moves from an extracted position to a retracted position.

In the solutions present on the market the electromagnetic actuator is powered at high voltage (for example at 220 V). The electromagnetic actuator and the lock switch are connected to the terminals of the switch module by means of metal strips (conductors) borne by the casing of the switch module, whose ends form the terminals for the connection of the switch module to the control unit of the appliance.

Known solutions often need modifications according to the customer's requests. For example, the market can request lock switch modules with a different number of poles.

One of the drawbacks of the solutions according to the prior art is that to modify the lock switch module according to market demands it is often necessary to redo the layout of the conductive metal strips and of the parts of the casing in which the conductive metal strips are positioned and fixed. This entails the need to have available production equipment that is diversified according to the different models of lock switch modules, which entails high costs for production equipment and poor flexibility because of the need to modify the production lines.

PURPOSE AND BRIEF SUMMARY OF THE INVENTION

The purpose of the present invention is to provide a lock switch module for a door-lock for appliances that overcomes the problems of the prior art.

According to the present invention, this purpose is achieved by a lock switch module having the features set forth in claim 1.

The claims are an integral part of the teach administered in relation to the invention.

BRIEF DESCRIPTION OF THE DRAWINGS

The present invention will now be described in detail with reference to the accompanying drawings, given purely by way of non-limiting example, in which.

It will be appreciated that for clarity and simplicity of illustration, the various figures may not be reproduced in the same scale. It will also be appreciated that in the various figures some parts or components may not be illustrated to simplify the comprehension of the figures.

DETAILED DESCRIPTION

Figure 1:
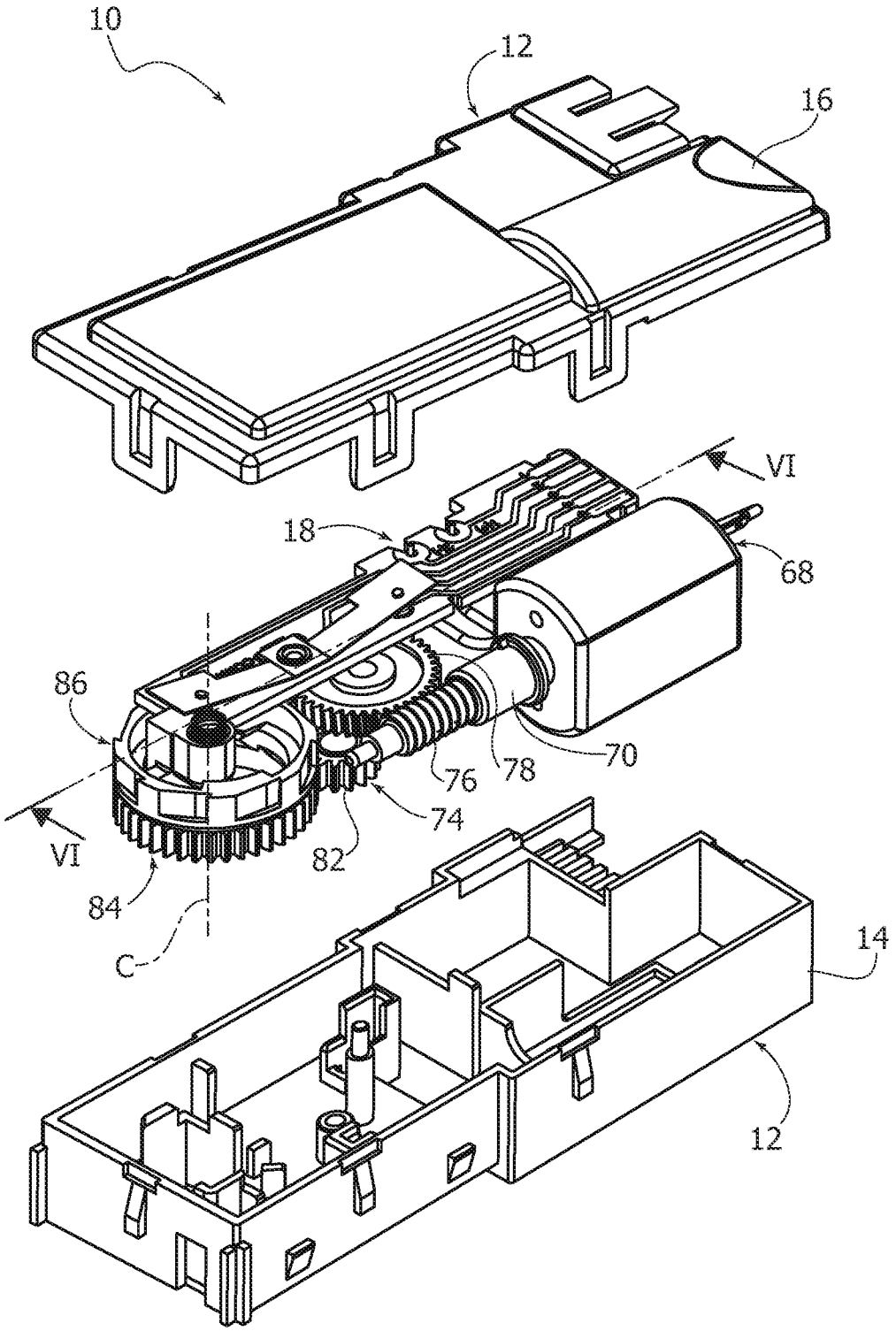
FIG. 1 is a partially exploded perspective view of an embodiment of a lock switch module according to the present invention.
Figure 2:
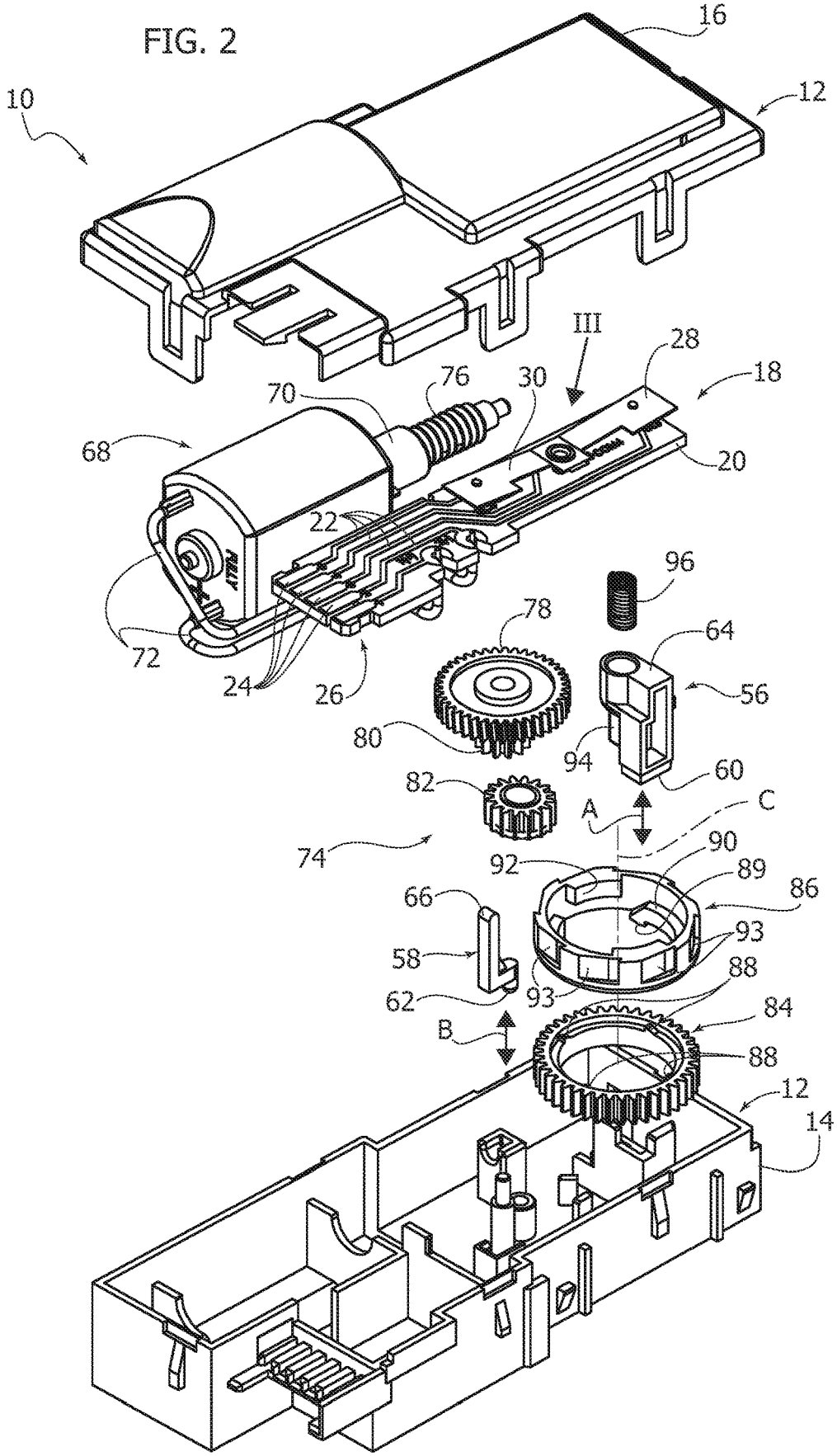
FIG. 2 is an exploded perspective view of the lock switch module of FIG. 1.

In FIGS. 1 and 2, the numeral 10 designates a lock switch module for a door lock of an appliance, for example a washer, washer-dryer, etc. The lock switch module 10 comprises a box-shaped casing 12 including a base 14 and a lid 16, which can be snap-fixed together.

Figure 3:
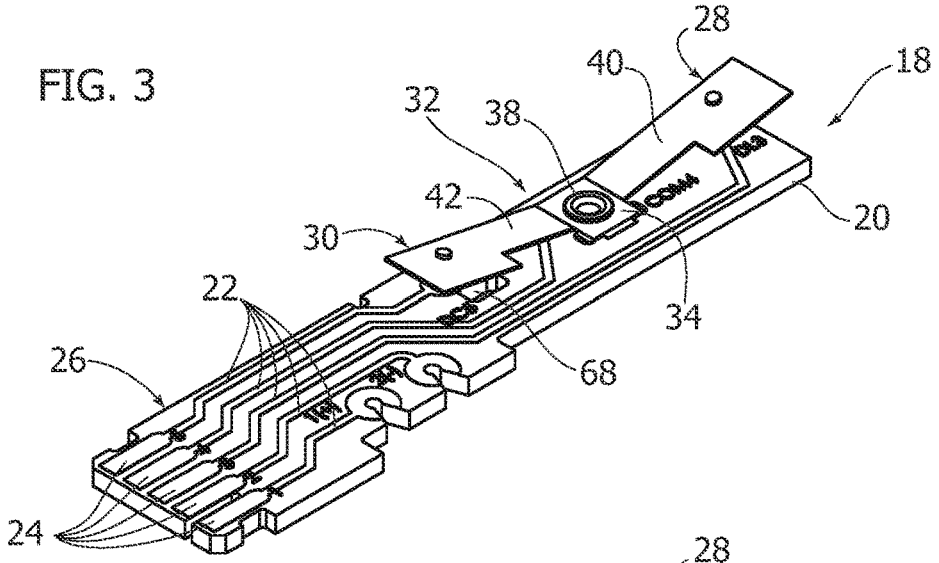
FIG. 3 is a perspective view in larger scale of the printed circuit board indicated by the arrow III in FIG. 2.
Figure 4:
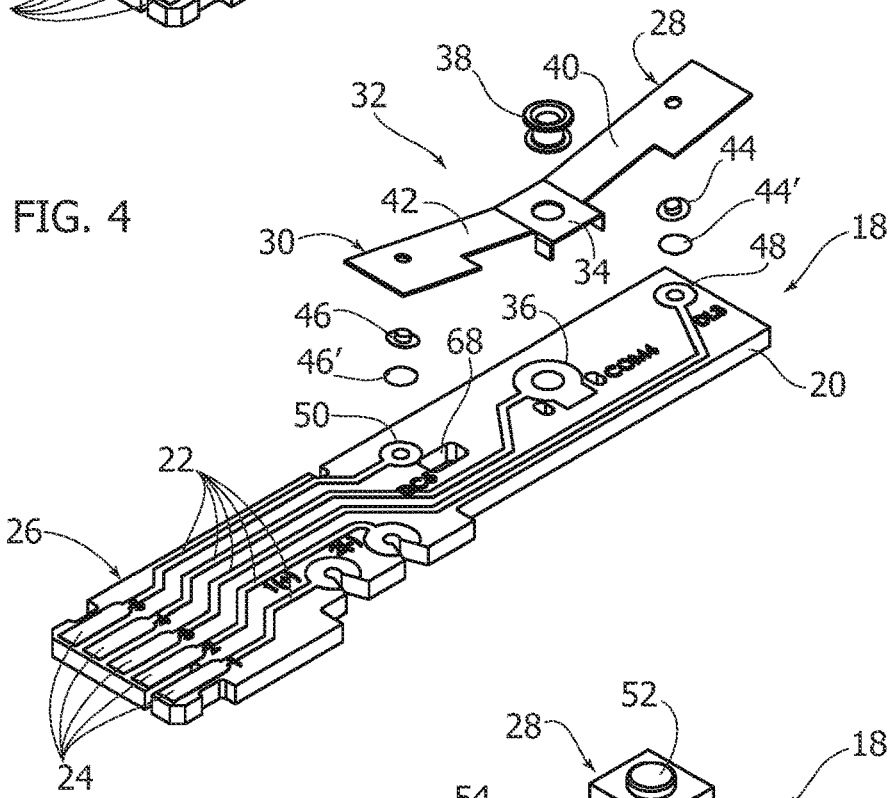
FIG. 4 is a partially exploded perspective view of the lock switch module of FIG. 3.

The lock switch module 10 comprises a printed circuit board 18 positioned inside the casing 12. With reference to FIGS. 3 and 4, the printed circuit board 18 comprises an insulating support 20 formed by a thin plate of electrically insulating material, preferably rigid. The printed circuit board 18 comprises a plurality of conductive tracks 22 applied on a surface of the insulating support 20. The conductive tracks 22 are connected to respective terminals 24 applied on the same surface of the support 20 on which the conductive tracks 22 are applied. The terminals 24 form a connector 26 for the electrical connection to an electronic control unit of the appliance. The connector 26 can be formed according to the standard RAST 2.5.

Figure 17:
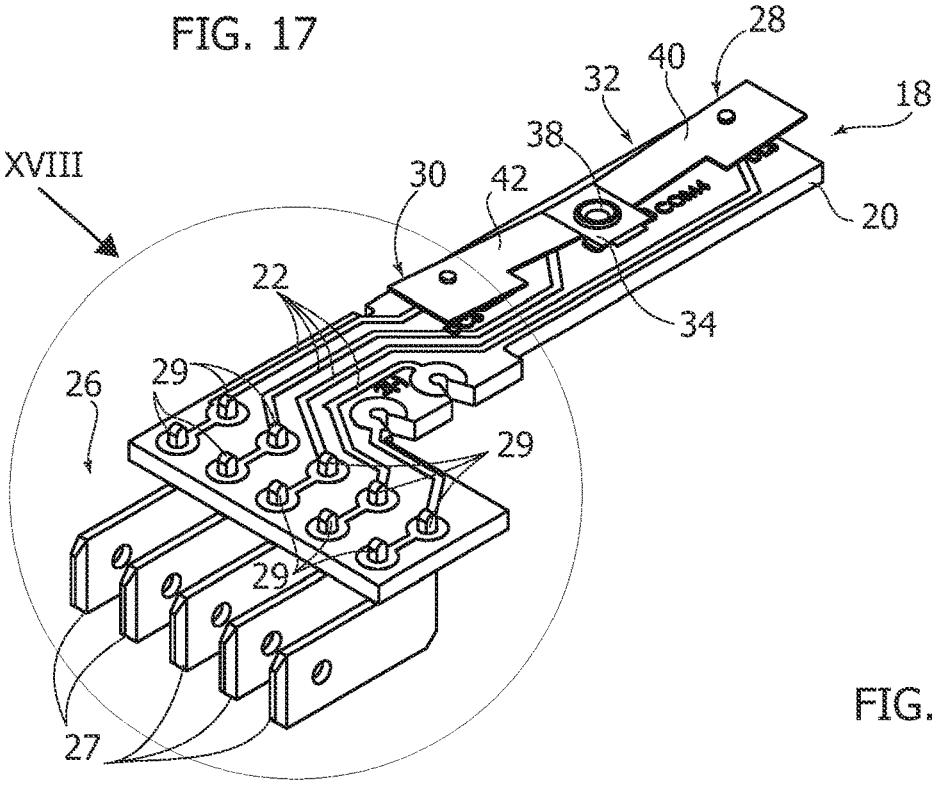
FIG. 17 is a perspective view illustrating an alternative embodiment of the printed circuit board of FIG. 3, and FIG. 18 a perspective view in larger scale of the part indicated by the arrow XVIII in FIG. 17.
Figure 18:
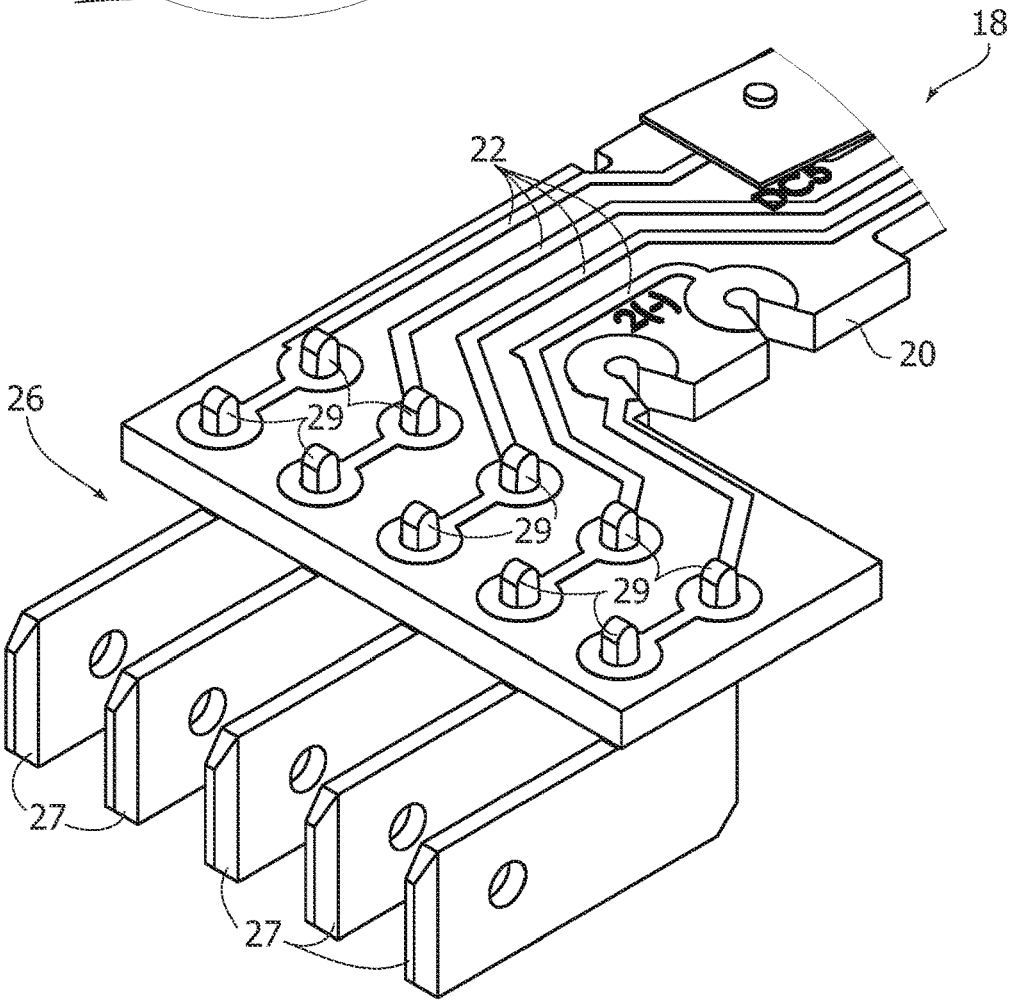

In an alternative embodiment illustrated in FIGS. 17 and 18, the connector 26 can comprises a plurality of fast-on metal tabs 27, for example with a dimension of 6.3 mm according to the RAST 5 standard. The metal tabs 27 can have respective pins 29 inserted and fixed inside respective holes of the insulating support 20 of the printed circuit board 18 and connected electrically to respective conductive tracks 22.

The printed circuit board 18 comprises at least one switch borne by the insulating support 20 and cooperating with at least two of the conductive tracks 22. In the embodiment illustrated in the figures, the printed circuit board 18 comprises a door-lock switch 28 and a door sensing switch 30. In the embodiment illustrated in FIGS. 1, 2, 3 and 4 the switches 28, 30 are formed by a conductive elastic plate 32 having a central part 34 fixed to the support 20 of the printed circuit board 18 connected electrically to a first conductive area 36, for example by means of a rivet 38. The conductive elastic plate 32 has two wings 40, 42 that project from opposite parts of the central portion 34 and provided with respective movable contacts 44, 46 that cooperate with respective fixed contacts 44', 46' (FIG. 4) fixed to conductive areas 48, 50 of respective conductive tracks 22. In resting conditions, the wings 40, 42 of the conductive elastic plate 32 are pressed elastically towards the insulating support 20 and keep the contacts 44, 46 bearing on the respective conductive areas 48, 50.

Figure 5:
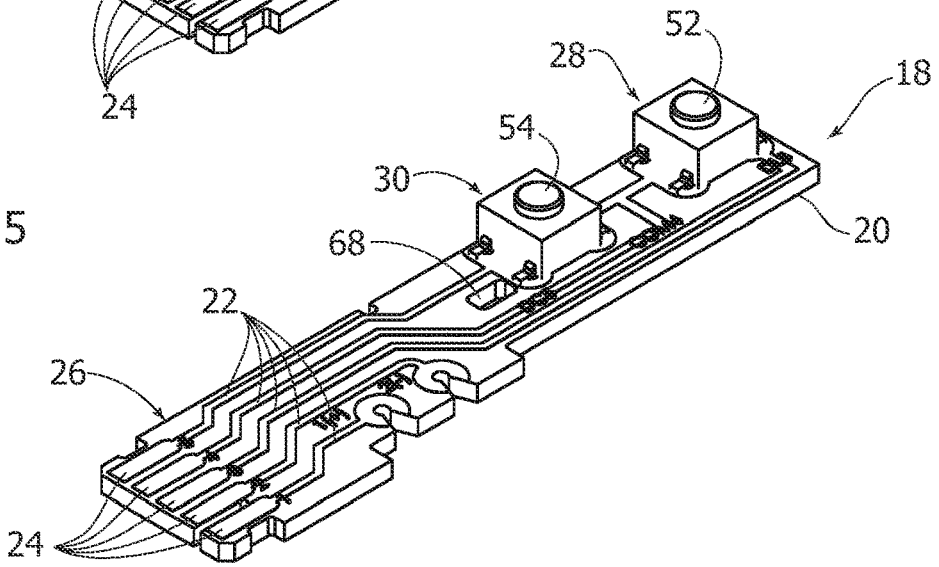
FIG. 5 is a perspective view illustrating an alternative embodiment of the printed circuit board of FIG. 3, FIGS. 6, 7 and 8 are sections according to the line VI-VI of FIG. 1 illustrating the lock switch module in position of: door open, door closed, and door closed and locked.

In the embodiment illustrated in FIG. 5, the switches 28, 30 are formed by microswitches fixed to the support 20 and connected electrically between the conductive tracks 22. The microswitches 28, 30 have respective control pushbuttons 52, 54. The microswitches 28, 30 can be soldered to the insulating support 20 of the printed circuit board 18 by SMD technology or dip soldering.

With reference to FIG. 2, the lock switch module 10 comprises a locking pin 56 and a door sensing pin 58 that cooperate, respectively, with the door lock switch 28 and with the door sensing switch 30. The locking pin 56 and the door sensing pin 58 are movable within the casing 12 along respective mutually parallel rectilinear directions A and B and have respective first ends 60, 62 that projected outside the casing 12 through respective openings formed in the base 14 of the casing 12. The locking pin 56 and the door sensing pin 58 are movable along the respective rectilinear directions A and B between extracted and retracted positions. The locking pin 56 and the door sensing pin 58 have respective second ends 64, 66 that cooperate with the respective switches 28, 30 to change the state of the switches 28, 30 between an open condition and a closed condition as a function of the retracted or extracted position of the pins 56, 58. The end 64 of the locking pin 56 acts on an end of the wing 40 of the elastic plate 32 that projects beyond an end edge of the support 20 of the printed circuit board 18. The door sensing pin 56 extends through a through hole 68 of the support 20 and cooperates with the wing 42 of the elastic plate 32.

Figure 9:
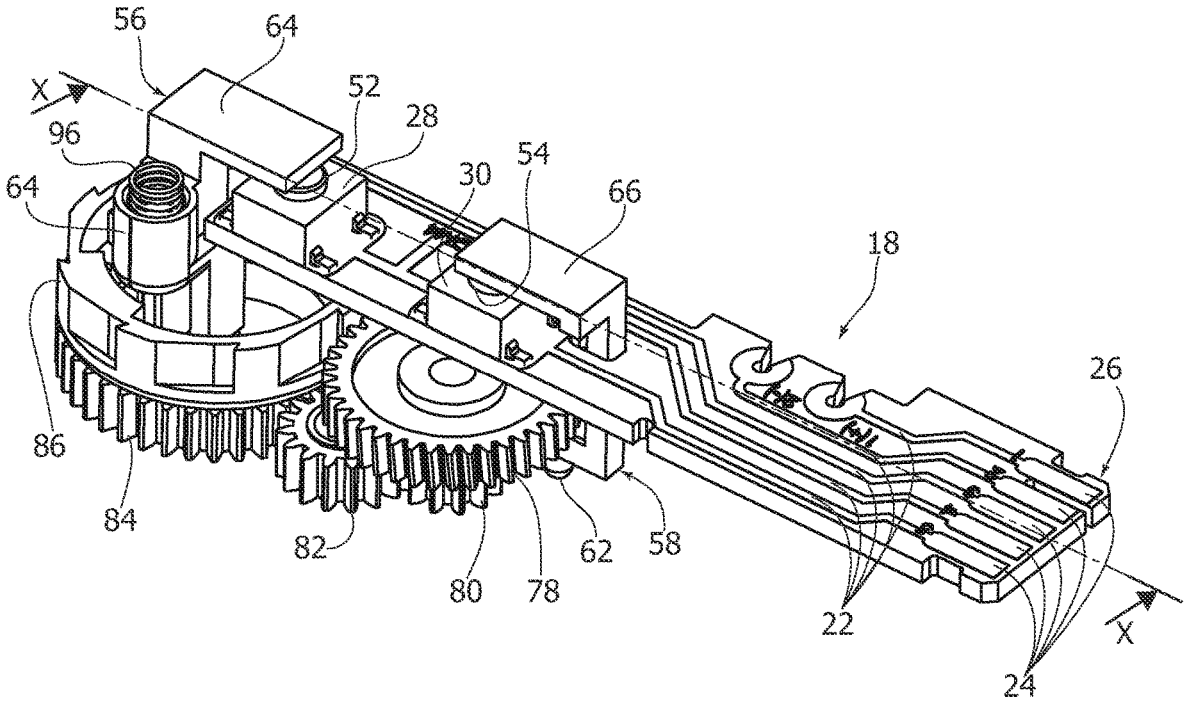
FIG. 9 is a perspective view of a part of the lock switch module having the printed circuit board of FIG. 5.
Figure 10:
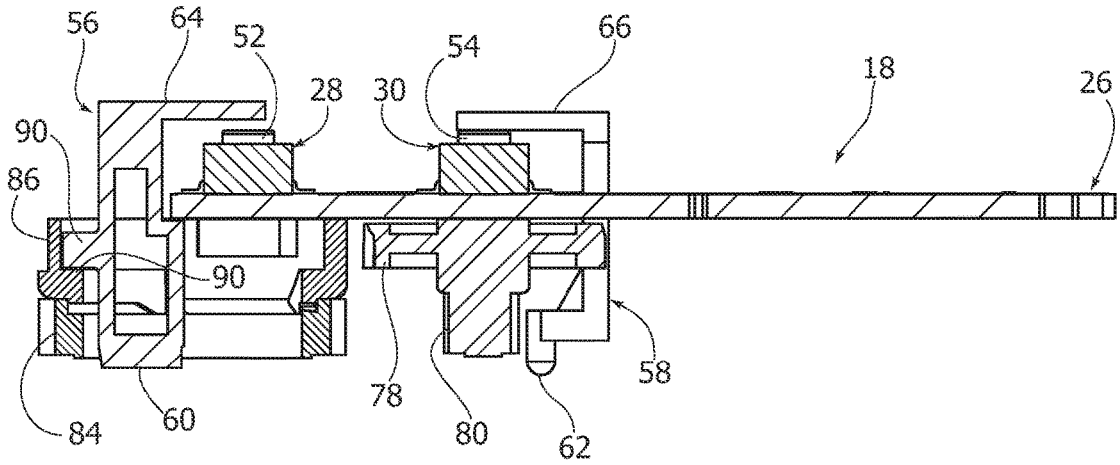
FIG. 10 is a section along the line X-X of FIG. 9.

If the switches 28, 30 are formed by pushbutton microswitches as in the embodiment illustrated in FIG. 5, the locking pin 56 and the door sensing pin 58 can have respective L-shaped second ends 64, 66 that cooperate with the pushbuttons 52, 54 of the micro switches 28, 30 as shown in FIGS. 9 and 10.

With reference to FIGS. 1 and 2, the lock switch module 10 comprises a low-voltage electric motor 68, for example 12V direct current, positioned inside the casing 12. The electric motor 68 has a rotating output shaft 70 whose axis of rotation can be parallel to the printed circuit board 18. The electric motor 68 is connected electrically to two conductive tracks 22 of the printed circuit board 18 by means of a pair of electric wires 72. Since the electric motor 68 is low-voltage, it is possible to integrate the electric power supply circuit of the motor 68 on the printed circuit board 18. This simplifies the mechanical and electric specifications of the lock switch module and reduces the costs for production line equipment.

The lock switch module 10 further comprises a transmission mechanism 74 mounted inside the casing 12 and operatively positioned between the output shaft 70 of the electric motor 68 and the locking pin 56 to drive, following the actuation of the electric motor 68, the movement of the locking pin 56 along the rectilinear direction A between a retracted unlocked position and an extracted locked position, and vice versa. The transmission mechanism 74 forms a speed reducer between the output shaft 70 of the electric motor 68 and the earn member 86.

With reference to FIGS. 1 and 2, the transmission mechanism 74 comprises a worm screw 76 fixed to the output shaft 70 of the electric motor 68 and that meshes with a helical wheel 78 borne by the casing 12 rotatably around a transverse axis with respect to the axis of rotation of the output shaft 70. A first gear wheel 80 is integral with the helical wheel 78 and meshes with a second gear wheel 82. The second gear wheel 82 also meshes with a third gear wheel 84. The third gear wheel 84 is rotatable around an axis C and actuates in rotation a cam member 86 around the same axis C. The cam member 86 has the shape of a ring, coaxial to the third gear wheel 84. The gear wheel 84 and the cam member 86 are in mutual contact along respective front edges that are provided with front teeth with triangular profile. In FIG. 2, the number 88 designates the front teeth of the third gear wheel 84, which cooperate with complementary front teeth 89 of the cam member 86.

The cam member 86 is provided on its inner surface with cams 90, 92 (FIG. 2) that engage a later protrusion 94 of the locking pin 56. A rotation of the cam member 86 around the axis C in the same direction actuates the movement of the locking pin 56 between the extracted position and the retracted position, and vice versa. A compression helical spring 96 can be provided to push elastically the locking pin 56 towards the extracted position. The cams 90, 92 of the cam member 86 can be formed by sectors projecting radially from an internal cylindrical surface of the cam member 86 and interrupted in circumferential direction. The cams 90, 92 can be mutually alternated in the circumferential direction.

The cams 90, 92 are made so as to actuate a movement of the locking pin 56 between the retracted position and the extracted position, and vice versa, with a rotation around the axis C in the same direction of the cam member 86, In this way, it is possible to actuate the movement of the locking pin 56 from the retracted position (door unlocking position) to the extracted position (door locking position), and vice versa, operating the electric motor 68 always in the same direction. Hence, a reversal of the electric motor 68 is not necessary for the locking and unlocking commands.

Figure 6:
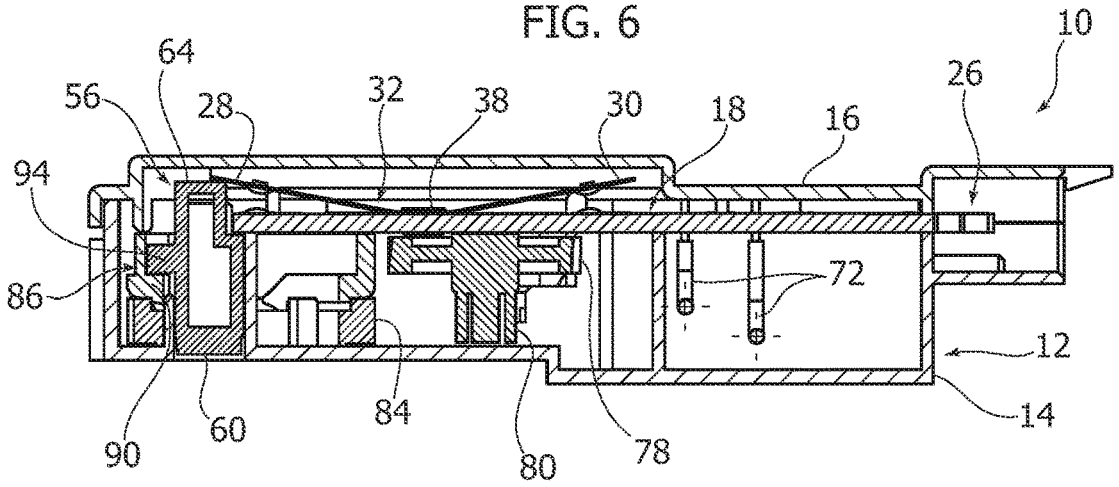
Figure 7:
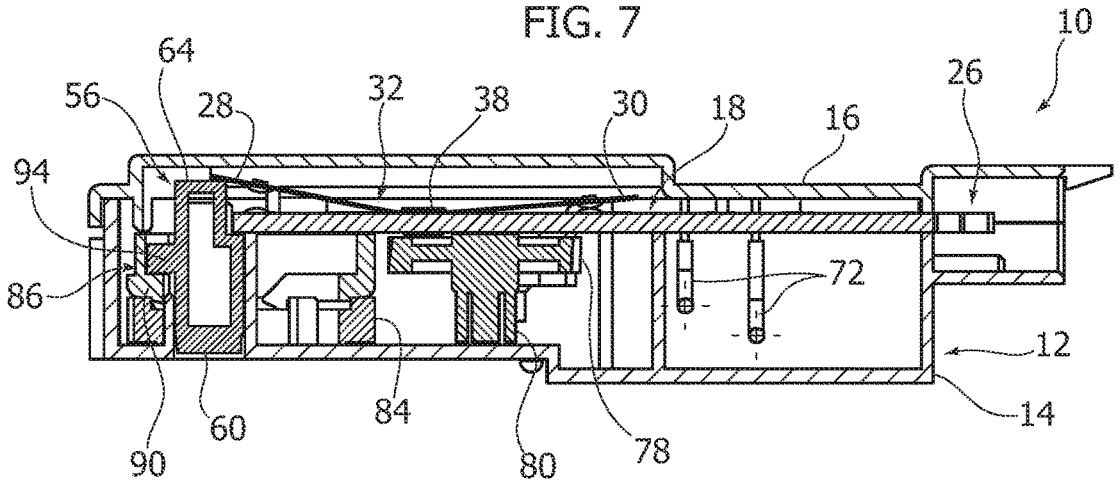
Figure 8:
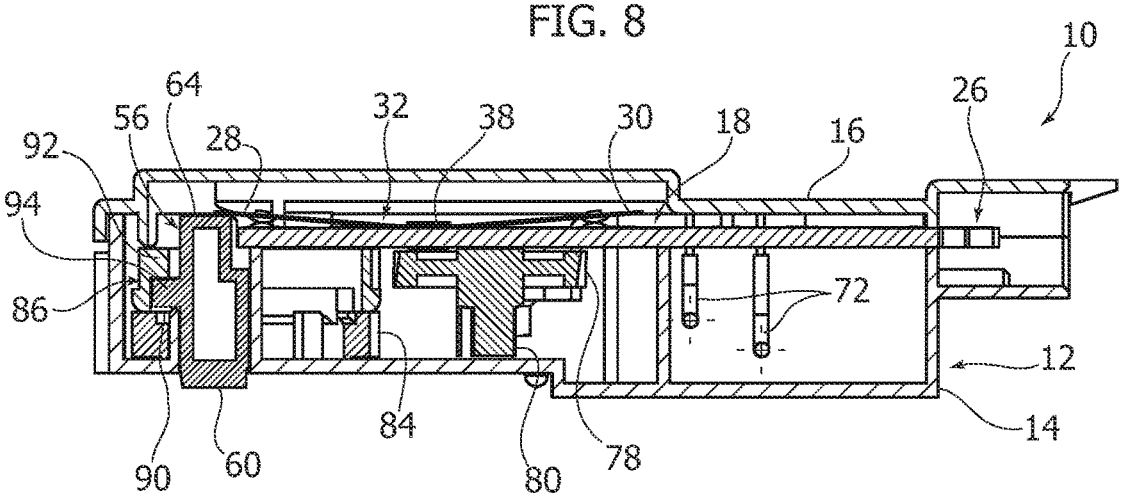

FIGS. 6, 7 and 8 illustrate the lock switch module 10 in different operating positions. FIG. 6 shows the open door condition. In this condition, the locking pin 56 and the door sensing pin 58 are both in retracted position and keep the switches 28, 30 in open position.

When the door of the appliance is closed (FIG. 7), the door sensing pin 58 moves towards its extracted position and closes the door sensing pin 30, The locking pin 56 is still in the retracted position.

With reference to FIG. 8, when the door sensing switch 30 signals that the door of the appliance is closed, the electronic control unit of the appliance activates the electric motor 68 which, through the transmission mechanism 74, actuates the movement of the locking pin 56 from the retracted unlocked position to the extracted locked position. In this condition, the second cam 92 of the cam member 86 arrests the locking pin 56 in the extracted position and prevents a return of the locking pin 56 towards the locking position. The locking pin 56 remains in the locking position for the duration of the operating cycle of the appliance. At the end of the operating cycle, the electronic control unit of the appliance operates the electric motor 68 which actuates, through the transmission mechanism 74, the movement of the locking pin 56 towards the retracted position. The locking pin 56 closes the door locking switch 28 when it reaches the locked position. The closure of the door locking switch 28 supplies a signal that is used by the electronic control unit of the appliance to interrupt the operation of the electric motor 68. During the unlocking phase, the locking pin 56 opens the door locking switch 28 when it reaches the retracted unlocked position. The opening of the door locking switch 28 is used by the electronic control unit of the appliance to deactivate the electric motor 68.

The cam member 86 can be rotated manually around the axis C through a series of radial teeth 93 to unlock the appliance manually in case of problems in operation or lack of electricity. The cam member 86 is connected to the third gear wheel 84 by means of front serrations with teeth having triangular profile. This coupling allows to rotate the cam member 86 around the axis C manually without rotating the gear wheel 84 that can be connected to the output shaft 70 of the electric motor 68 through an irreversible transmission.

Figure 11:
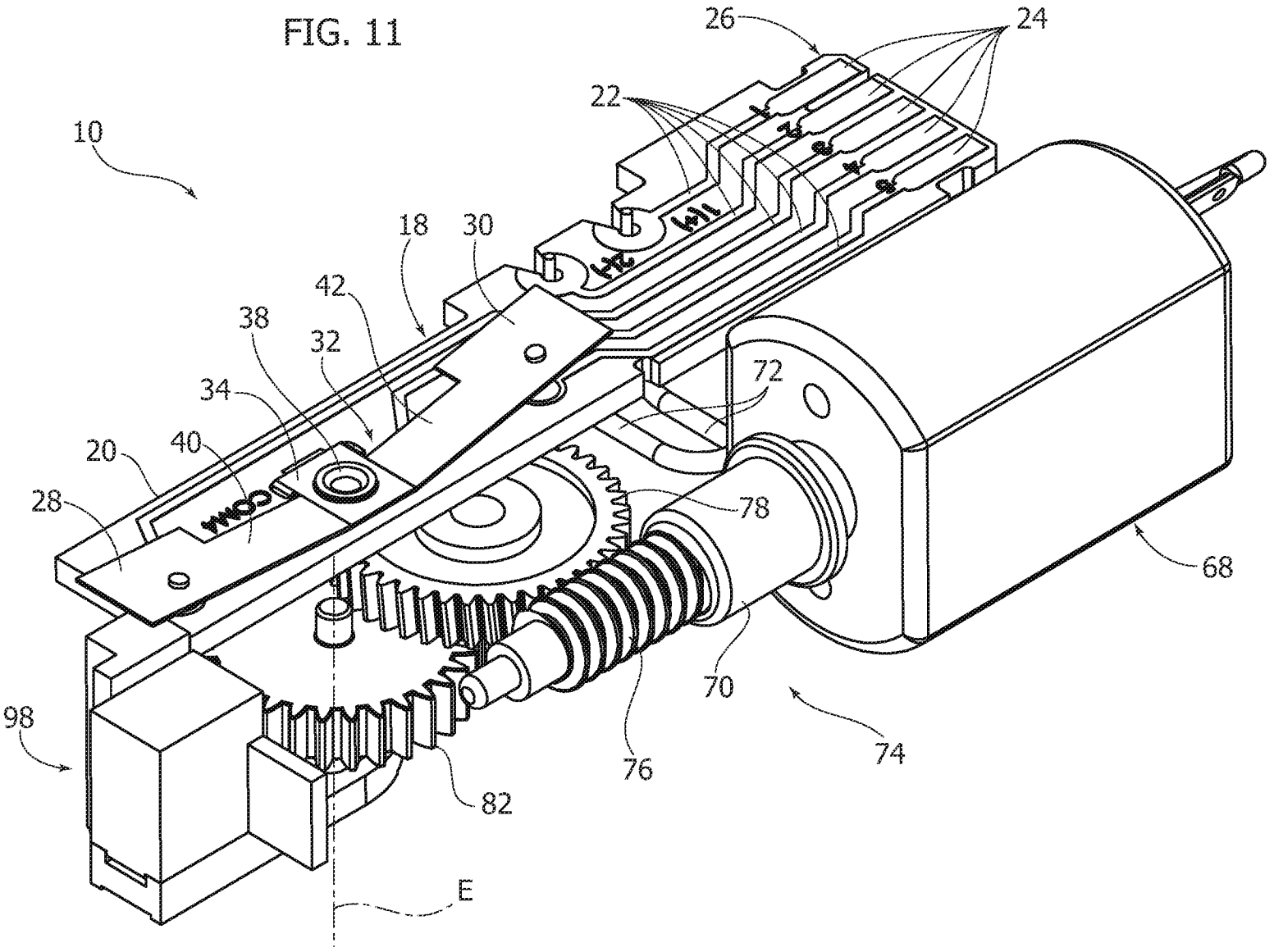
FIG. 11 is a perspective view of a second embodiment of a lock switch module according to the present invention.
Figure 12:
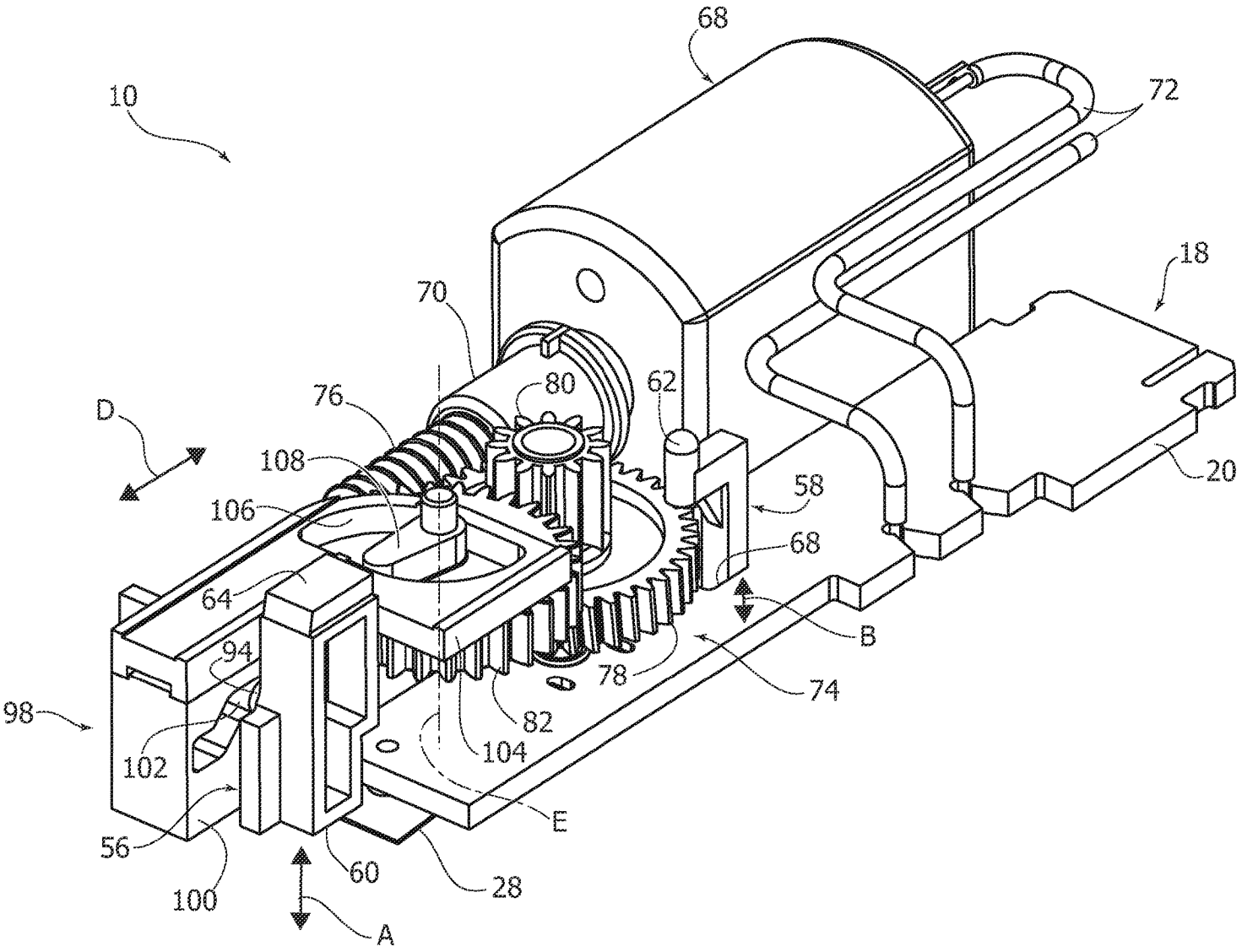
FIGS. 12 and 13 are perspective view from a different angle of the lock switch module of FIG. 11 respectively in the position of unlocked door and of locked door, FIGS. 14, 15 and 16 schematically show some of the electric circuits obtainable thanks to the use of the printed circuit board (PCB)
Figure 13:
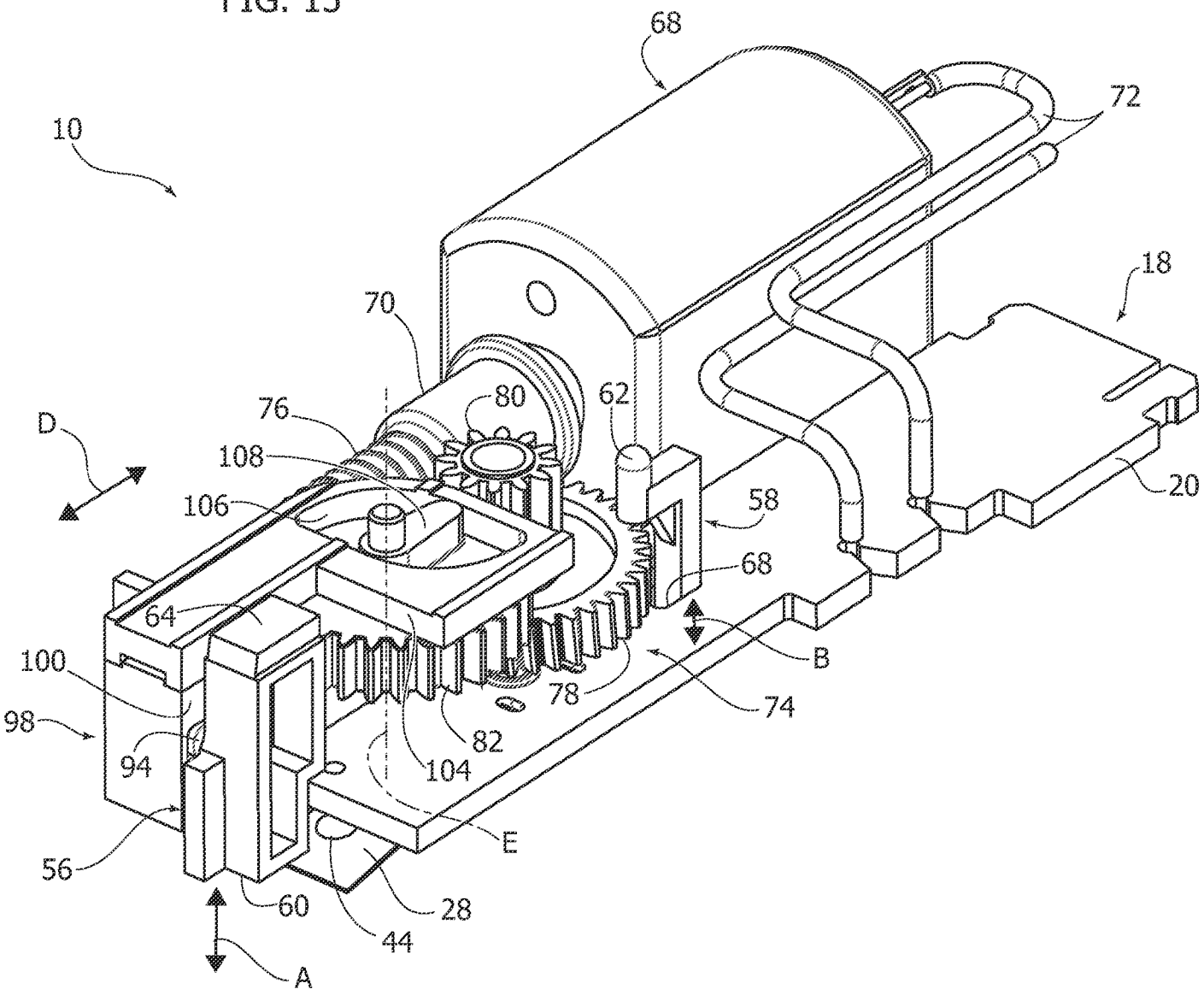

FIGS. 11-13 illustrate an alternative embodiment of the transmission mechanism 74 that actuates the movement of the locking pin 56 between the locked position and the unlocked position, and vice versa. The elements corresponding to those described previously are indicated with the same numerical references.

The transmission mechanism 74 comprises, as in the embodiment described previously, a worm screw 76 fixed to the output shaft 70 of the electric motor 68 and that meshes with a helical wheel 78 integral with a first gear wheel 80. The first gear wheel 80 meshes with a second gear wheel 82, as in the embodiment described previously.

In the embodiment of FIGS. 11-13, die transmission mechanism 74 comprises a cam member 98 that translates along a rectilinear direction parallel to the axis of rotation of the output shaft 70 of the electric motor 68. The cam member 98 has a lateral surface 100 on which is formed a cam 102 that is engaged by the lateral protrusion 94 of the locking pin 56 (FIG. 12).

The cam member 98 has a portion 104 having an opening 106 that is engaged by an eccentric pin 108 fixed to the second gear wheel 82. The electric pin 108 rotates around an axis E that is orthogonal with respect to the direction D. The engagement between the eccentric pin 108 and the inner surface of the opening 106 converts the rotating motion of the eccentric pin 108 around the axis E into a linear translation of the cam member 98 along the direction D. The rotation of the eccentric pin 108 always in the same direction actuates a reciprocating motion of the cam member 98 along the direction D.

The reciprocating motion of the cam member 98 along the direction D actuates, through the cam 102, a reciprocating motion of the locking pin 56 in the direction A between the retracted locked position shown in FIG. 12 and the extracted locked position shown in FIG. 13. In this embodiment, too, the electric motor 68 operates always in the same direction to actuate the locking motion or the unlocking motion of the locking pin 56.

Figure 15:
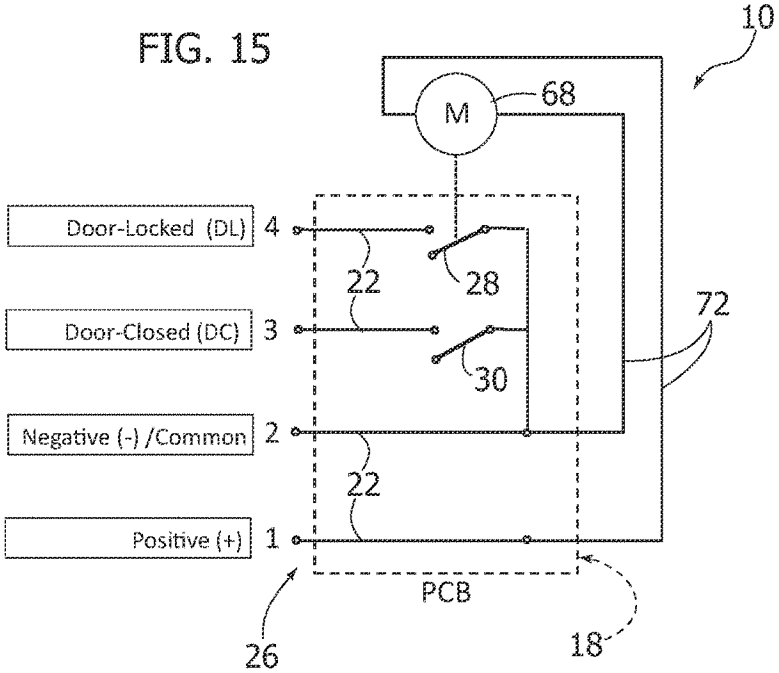
Figure 16:
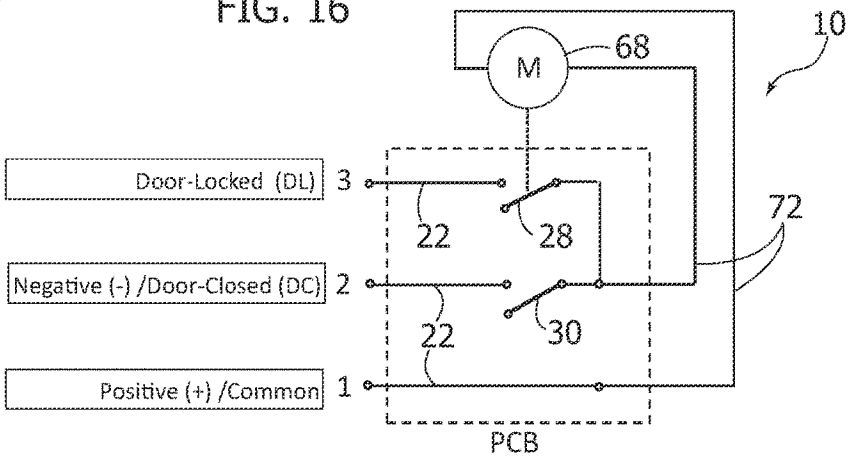
Figure 14:
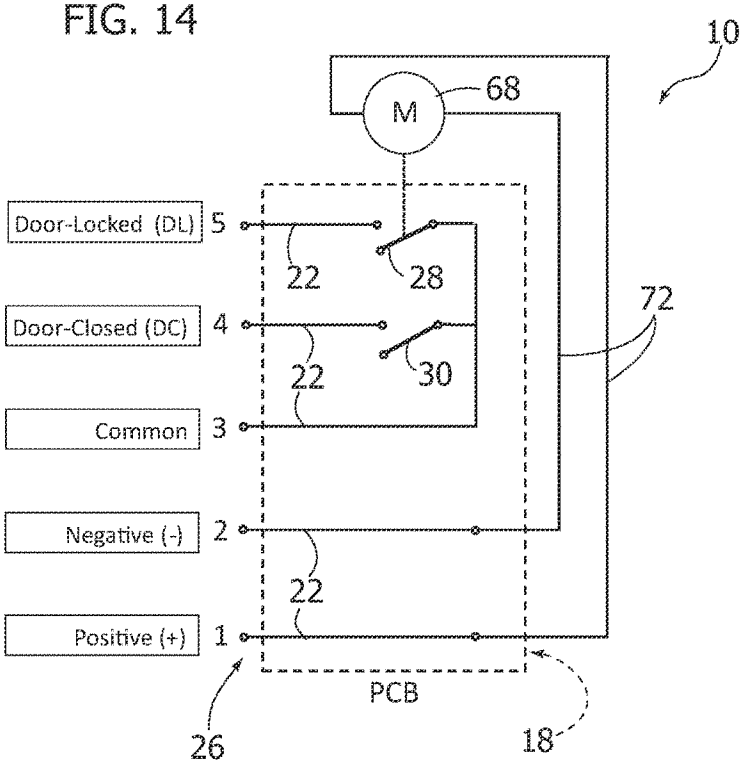

In the solution according to the present invention, all the electric connection of the lock switch module 10 are provided on the printed circuit board 18, This allows to change the layout of the electric wiring according to the customer's needs, modifying only the number and the arrangement of the conductive tracks 22 and of the related terminals 24. Modifying the layout of the electric wiring of the lock switch module does not entail any modification to the casing 12 or to the arrangement of the components inside the casing. FIGS. 14-16 show for example that with the solution according to the present invention it is possible to change the electric wiring very easily between a five-pole solution (FIG. 14) to a four-pole solution (FIG. 15) or a three-pole solution (FIG. 16). This modification does not require changing production equipment or modification to assembly line of the lock switch module. It is sufficient to change the printed circuit board 18 and, on the same production line, lock switch modules configured differently according to the customer's needs can be obtained.

The lock switch module according to the present invention has multiple advantages, including:

- it is a simple solution,
- the electric motor can have a very limited current absorption (lower than 1 A),
- the dimensions and the interface of the motorized lock switch module according to the present invention allow pin-to-pin compatibility with respect to switch modules according to the prior art with solenoid electromagnetic actuator,
- the locking and unlocking time is short (less than 500 ms),
- it allows very simply to obtain a RAST 2.5 connection or, alternatively, a RAST 5 connection with 6.3 mm fast-on tabs,
- the electric motor is always actuated in the same direction to drive the locking and unlocking of the door; thus, it is not necessary to reverse the polarity of the motor to drive the locking or unlocking of the appliance: this is an important advantage because it allows the use of the lock switch module according to the present invention without any hardware modification to the electronic control units of existing appliances,
- the device is powered at low voltage, according to the characteristics of the electric motor, for example 12 V DC.

Naturally, without prejudice to the principle of the invention, the construction details and the embodiments may be amply varied with respect to what is set forth and illustrated herein, without thereby departing from the scope of the invention as defined by the following claims.

The invention claimed is:

1. A lock switch module for a door-lock for appliances, comprising:

- a printed circuit board including an insulating support, a plurality of conductive tracks applied to the insulating support, an electrical connector borne by the insulating support and having a plurality of terminals connected electrically to respective conductive tracks, and a door-lock switch borne by the insulating support and electrically connected between two of the conductive tracks,
- a locking pin movable between a retracted position and an extracted position and cooperating with the door-lock switch (28) to change the state of the door-lock switch (28) following the position change between the retracted position and the extracted position, and vice versa, a low voltage electric motor having a rotating output shaft and connected electrically to at least two conductive tracks of the printed circuit board, and a transmission mechanism operatively positioned between the output shaft of the electric motor and the locking pin to drive, following the actuation of the electric motor, the movement of the locking pin between the retracted position and an extracted position, and vice versa.

2. The lock switch module according to claim 1, wherein the transmission mechanism comprises a cam member having at least a cam cooperating with a protrusion of the locking pin, the cam member being connected to the output shaft of the electric motor through a geared speed reducer.

3. The lock switch module according to claim 1, wherein the transmission mechanism comprises a worm screw cooperating with a helical wheel and a chain of gear wheels.

4. The lock switch module according to claim 3, wherein the cam member is rotatable around an axis of rotation orthogonal to the axis of rotation of the output shaft of the electric motor.

5. The lock switch module according to claim 4, wherein the cam member is connected to a gear wheel by means of front teeth that allow to rotate the cam member manually with respect to the gear wheel.

6. The lock switch module according to claim 1, wherein the cam member is movable alternatively along a rectilinear direction parallel to the axis of rotation of the output shaft of the electric motor.

7. The lock switch module according to claim 6, wherein the cam member comprises an opening engaged by an eccentric pin actuated in rotation by a chain of gear wheel.

8. The lock switch module according to claim 7, wherein the printed circuit board comprises a door sensing pin cooperating with a door sensing pin.

9. The lock switch module according to claim 8, wherein the door locking switch and the door sensing switch are formed by a conductive elastic plate fixed to the support of the printed circuit board and having a pair of wings bearing respective movable contacts that cooperate with respective fixed contacts fixed to conductive areas of respective conductive tracks.

10. The lock switch module according to claim 8, wherein the door locking switch and the door sensing switch are formed by pushbutton microswitches soldered to the printed circuit board.

* * * * *